US012790783B2

(12) United States Patent
Ahmad et al.

(10) Patent No.: US 12,790,783 B2
(45) Date of Patent: Nov. 10, 2026

(54) SMART FRICTION PENDULUM SYSTEM

(71) Applicant: The Governors of the University of Alberta, Edmonton (CA)

(72) Inventors: Rafiq Ahmad, Edmonton (CA); Shahin Zareie, Edmonton (CA)

(73) Assignee: The Governors of the University of Alberta, Edmonton (CA)

( * ) Notice: Subject to any disclaimer, the term of this patent is extended or adjusted under 35 U.S.C. 154(b) by 102 days.

(21) Appl. No.: 18/719,483

(22) PCT Filed: Dec. 16, 2022

(86) PCT No.: PCT/CA2022/051853
§ 371 (c)(1),
(2) Date: Jun. 13, 2024

(87) PCT Pub. No.: WO2023/108301
PCT Pub. Date: Jun. 22, 2023

(65) Prior Publication Data

US 2025/0043528 A1 Feb. 6, 2025

Related U.S. Application Data

(60) Provisional application No. 63/290,872, filed on Dec. 17, 2021.

(51) Int. Cl.
*E02D 27/34* (2006.01)
*E02D 31/08* (2006.01)

(52) U.S. Cl.
CPC ..... *E02D 27/34* (2013.01); *E02D 31/08* (2013.01)

(58) Field of Classification Search
CPC ..... E04H 9/023; E04H 9/021; E02D 31/08; E02D 27/34

(Continued)

(56) References Cited

U.S. PATENT DOCUMENTS 5,669,189 A * 9/1997 Logiadis ..... E04H 9/021 52/167.6
6,021,992 A * 2/2000 Yen ..... F16F 7/08 248/560

(Continued)

FOREIGN PATENT DOCUMENTS

CN 208363327 U * 1/2019
CN 109837993 A 6/2019

(Continued)

OTHER PUBLICATIONS

English machine translation for CN-111395568 (Year: 2025).*
English machine translation for CN-113374107 (Year: 2025).*
Int'l Search Report for PCT/CA2022/051853, dated Mar. 17, 2023.

*Primary Examiner* — Christine T Cajilig
(74) *Attorney, Agent, or Firm* — MaxGoLaw PLLC

(57) ABSTRACT

A smart friction pendulum system including an upper spherical plate and a lower spherical plate each having a sliding surface, a slider positioned between the upper spherical plate and the lower spherical plate, and a plurality of shape memory alloy (SMA) wires each having a first end attached to the upper spherical plate and a second end of attached to the lower spherical plate. The smart friction pendulum system is configured to be attached between the foundation and base mass of a building to preserve the superstructures under the lateral loads. While the lateral loads move the plates side to side, the system dissipates energy by providing friction between sliding material and sliding surface. The SMA wires also absorb the energy when in inelastic reversible phase. The embedded diagonal SMA wires make the whole system recover the initial position fully.

18 Claims, 16 Drawing Sheets

(58) Field of Classification Search
USPC ..... 52/167.5, 167.6
See application file for complete search history.

(56) References Cited

U.S. PATENT DOCUMENTS

| | | | | |
|---|---|---|---|---|
| 7,547,142 | B2 * | 6/2009 | Robinson | E01D 19/046 248/560 |
| 2017/0204603 | A1 * | 7/2017 | Tsai | E04H 9/022 |
| 2019/0368138 | A1 * | 12/2019 | Weber | E01D 19/046 |
| 2022/0081925 | A1 * | 3/2022 | Noori | E04H 9/021 |

FOREIGN PATENT DOCUMENTS

| | | | | | |
|---|---|---|---|---|---|
| CN | 111395568 | A | * | 7/2020 | E04B 1/98 |
| CN | 113235407 | A | | 8/2021 | |
| CN | 113374107 | A | | 9/2021 | |
| CN | 114033062 | A | | 2/2022 | |
| CN | 113374107 | B | * | 5/2024 | E04B 1/98 |
| CN | 114033062 | B | * | 7/2024 | E04H 9/0237 |
| WO | 2020006850 | A1 | | 1/2020 | |

* cited by examiner

Strain: $\varepsilon=\Delta L/L$
Stress: $\sigma=\varepsilon E$ $S=r\alpha$
Pre-strain: $\varepsilon=\Delta L/L=L+S-L/L=S/L$
Pre-stress: $\sigma=ES/L$ $S'=r\alpha'$
$E'=\Delta L/L=L+S'-L/L=S'/L$
$\sigma'=ES'/L$

SMART FRICTION PENDULUM SYSTEM

RELATED APPLICATIONS

This application claims priority benefit of U.S. Provisional Application Ser. No. 63/290,872 filed on Dec. 17, 2021, the contents of which are hereby incorporated by reference.

FIELD OF THE INVENTION

The present invention relates to a friction pendulum system for civil infrastructure, and more particularly, it relates to a smart friction pendulum system having a shape memory alloy configured to filter ground movement from the superstructure of the infrastructure and dissipate the energy transmitted to the main structure in order to preserve such civil infrastructure when exposed to seismic loads and restore the original position fully after such events.

BACKGROUND OF THE INVENTION

Civil infrastructures around the world, particularly buildings, are easily devastated by strong earthquakes, such as the 1995 Kobe earthquake in Japan, the 2003 Bam earthquake in Iran, and the 1979 Imperial Valley earthquake in the United States. As a result, many people lost their lives, and many more people were injured due to the collapse of buildings. Such devastating building collapses occur in part because the structural elements of such buildings fail when the applied loads exceed what the building is capable of withstanding and because of the buildings' limited energy dissipation.

Structural control systems have been designed and installed in many buildings to preserve buildings exposed to lateral loads, like seismic loads experienced in modest to strong earthquakes. Such systems separate the structures from the ground, filtering ground motion movement from the superstructure of the building and dissipating the energy transmitted to the main structure. In many structural control systems, the loads transmitted from foundations are controlled by those systems in the superstructures of the building. One alternative way of keeping the building functional is to filter ground movement from the foundation by the superstructure of buildings by implementing structural control systems, like the Friction Pendulum System (FPS), as shown in FIGS. 1A and 1B, between the foundation and the base mass of buildings. Such systems dissipate the energy transmitted to the main structure. In other words, the system filters the earthquake loads to structures to keep their functionality and prevent damage.

A FPS is a seismic isolation bearing, as shown in FIGS. 2A and 2B, which is a curved sliding bearing based on the pendulum mechanism. The FPS's functionality is based on the energy dissipation via friction and restoring. The system is effective in decreasing the acceleration of the superstructures and does not make large base displacements. The system is widely used in many civil infrastructures, such as the US Court of Appeals Building in San Francisco and Washington State Emergency Operations Center at Camp Murray. The main disadvantage of the conventional FPSs is that FSPs are unable to restore the original position fully, and energy dissipation is totally a function of the relative velocity between the slider and spherical plates. In other words, in a conventional friction pendulum system the residual deformation remains in the foundation of structures, leading to a change in the original shape of the building after the seismic events, as shown in FIGS. 1B and 2B.

Thus, there exists a need for a structural control system for civil infrastructures that filters ground movement from the superstructure of the infrastructure and dissipates the energy transmitted to the main structure in order to preserve such structures when exposed to seismic loads and restore the original position fully after such events.

SUMMARY OF THE INVENTION

The present invention provides a smart friction pendulum system that includes an upper spherical plate and a lower spherical plate each having a sliding surface, a slider positioned between the upper spherical plate and the lower spherical plate, and a plurality of shape memory alloy (SMA) wires each having a first end attached to the upper spherical plate and a second end of attached to the lower spherical plate. The smart friction pendulum system is configured to be attached between the foundation and base mass of a building to preserve the superstructures under the lateral loads. While the lateral loads move the plates of the system to the right side or the left side, the system dissipates energy by providing friction between sliding material and sliding surface. The SMA wires also absorb the energy when it goes to the inelastic reversible phase. The curved surface on the spherical plates help the slider and spherical plates to partially move back to the initial position. The embedded diagonal SMA wires make the whole system recover the initial position fully.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DESCRIPTION OF THE INVENTION

Figure 1A:
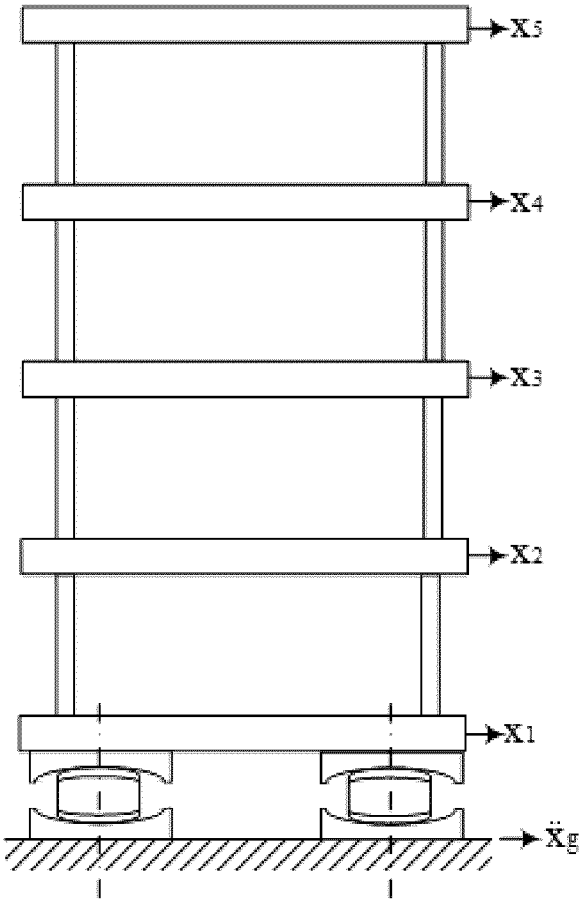
FIG. 1A PRIOR ART
FIG. 1A shows an existing friction pendulum system installed on a structure prior to an earthquake.
Figure 1B:
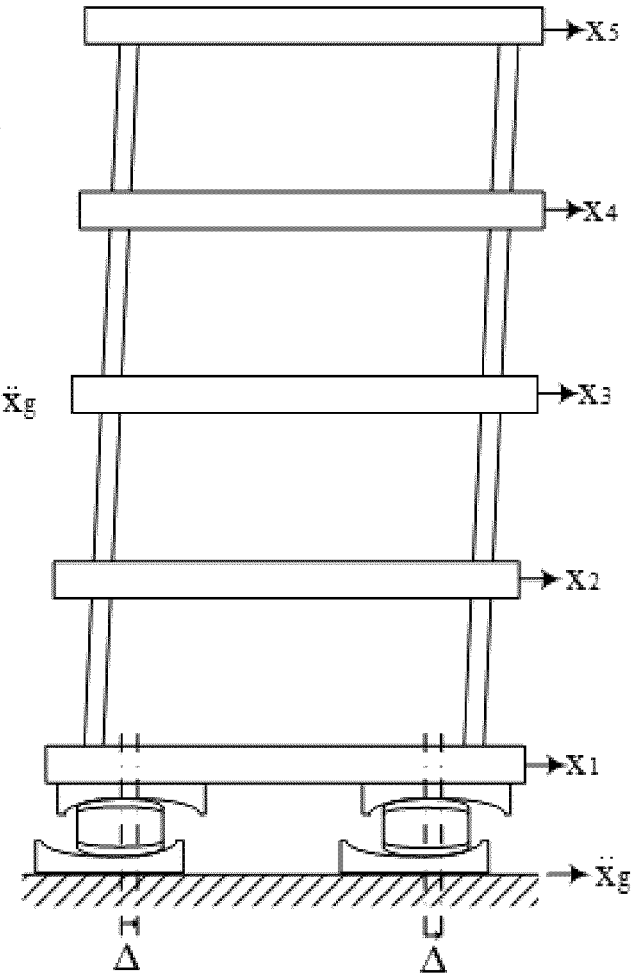
FIG. 1B PRIOR ART
FIG. 1B shows the existing friction pendulum system installed on the structure of FIG. 1A after an earthquake.
Figure 2A:
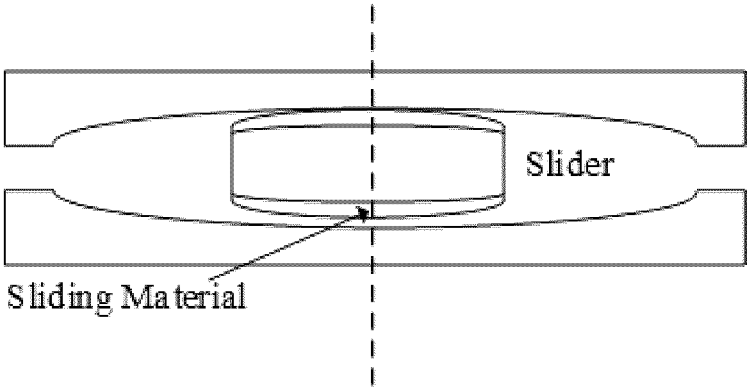
FIG. 2A PRIOR ART
FIG. 2A is a schematic diagram of the existing friction pendulum system of FIG. 1A prior to an earthquake.
Figure 2B:
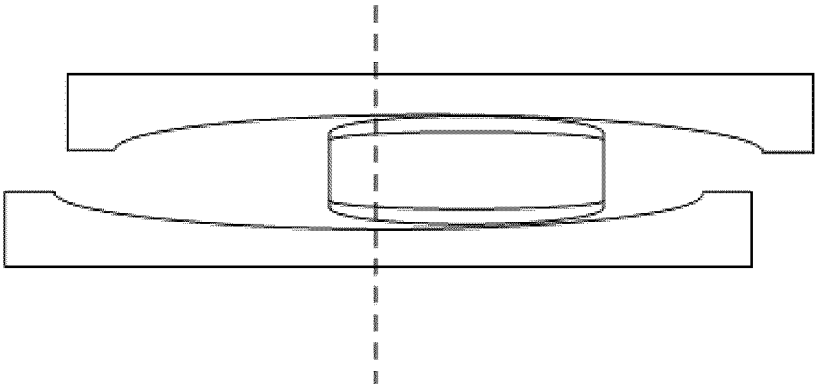
FIG. 2B PRIOR ART
FIG. 2B is a schematic diagram of the existing friction pendulum system of FIG. 2A after an earthquake.

The present invention has utility as a structural control system for civil infrastructures that filters ground movement from the superstructure of the infrastructure and dissipates the energy transmitted to the main structure in order to preserve such structures when exposed to seismic loads and restore the original position fully after such events. According to embodiments, the present invention provides a Friction Pendulum System (FPS) incorporated with a Shape Memory Alloy (SMA) in order to add the recovery capability and more energy dissipation capacity as compared with a conventional FPS. It should be appreciated that the usage of SMA wires in the present invention and based on the configuration of the wires, affords dissipation of horizontal load forces, vertical load forces, or a combination thereof. According to certain inventive embodiments, an FPS is integrated with a smart metallic alloy to push the system back into the original position after experiencing a seismic load. According to embodiments, the alloy is capable of recovering the original state even after experiencing substantial elongation relative to the initial length. Accordingly, the present invention provides significantly enhanced structural behavior and preserves civil infrastructure in their lifespan. As a result, the present invention affords increased energy dissipation of external loads while also providing enhanced recovery phenomena in structures after removing the loads, compared to a conventional FPS.

The present invention will now be described with reference to the following embodiments. As is apparent by these descriptions, this invention can be embodied in different forms and should not be construed as limited to the embodiments set forth herein. Rather, these embodiments are provided so that this disclosure will be thorough and complete, and will fully convey the scope of the invention to those skilled in the art. For example, features illustrated with respect to one embodiment can be incorporated into other embodiments, and features illustrated with respect to a particular embodiment may be deleted from the embodiment. In addition, numerous variations and additions to the embodiments suggested herein will be apparent to those skilled in the art in light of the instant disclosure, which do not depart from the instant invention. Hence, the following specification is intended to illustrate some particular embodiments of the invention, and not to exhaustively specify all permutations, combinations, and variations thereof.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention.

Unless indicated otherwise, explicitly or by context, the following terms are used herein as set forth below.

As used in the description of the invention and the appended claims, the singular forms "a," "an" and "the" are intended to include the plural forms as well, unless the context clearly indicates otherwise.

Also as used herein, "and/or" refers to and encompasses any and all possible combinations of one or more of the associated listed items, as well as the lack of combinations when interpreted in the alternative ("or").

Figure 4A:
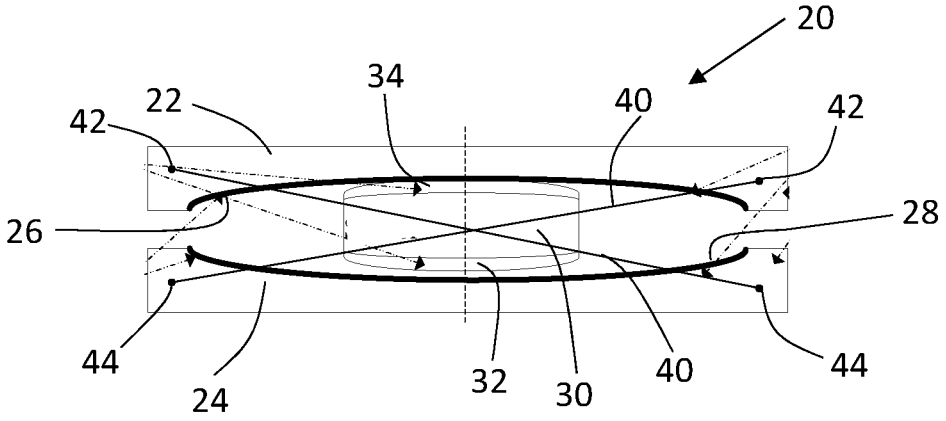
FIG. 4 is a schematic diagram of a smart friction pendulum system according to embodiments of the present disclosure.
Figure 5:
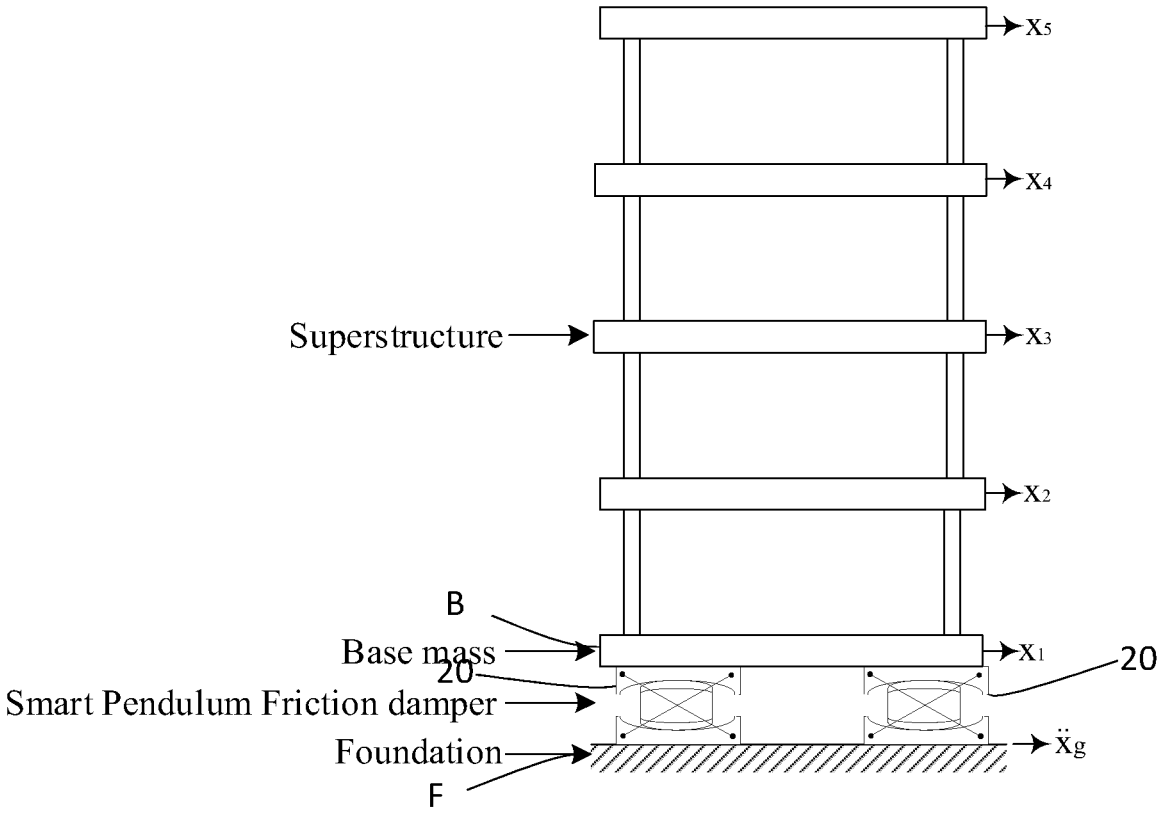
FIG. 5 is a schematic diagram of the smart friction pendulum system of FIG. 4 installed in a building.
Figure 6A:
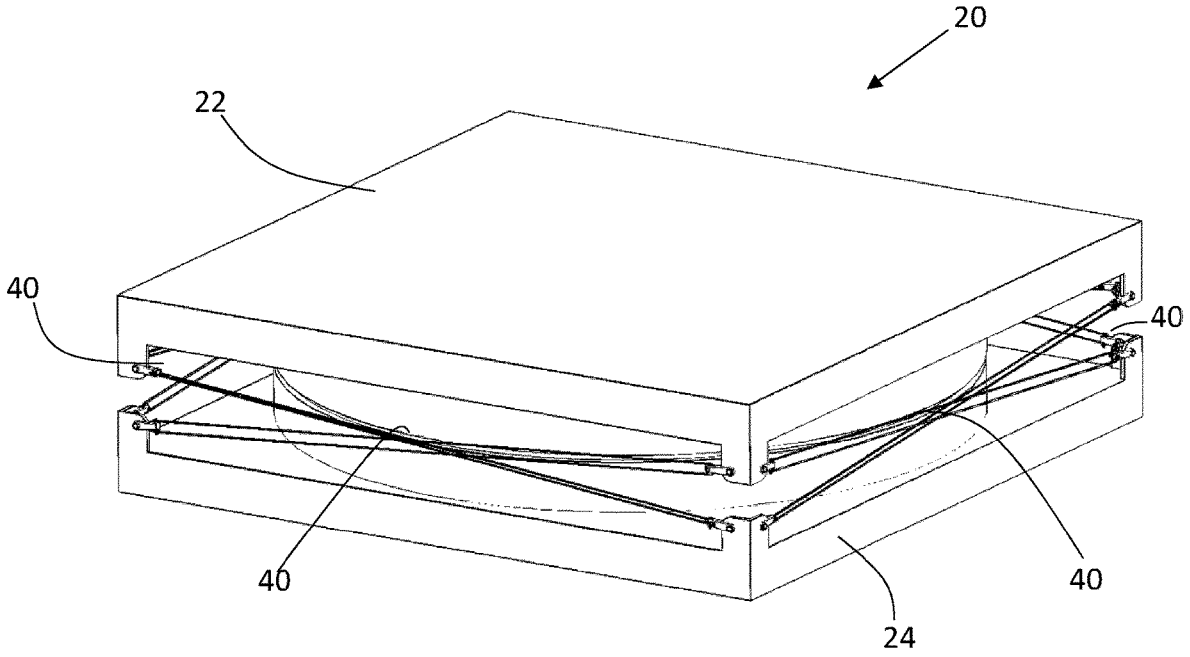
FIG. 6A is a perspective view of a smart friction pendulum system according to embodiments of the present disclosure.
Figure 6B:
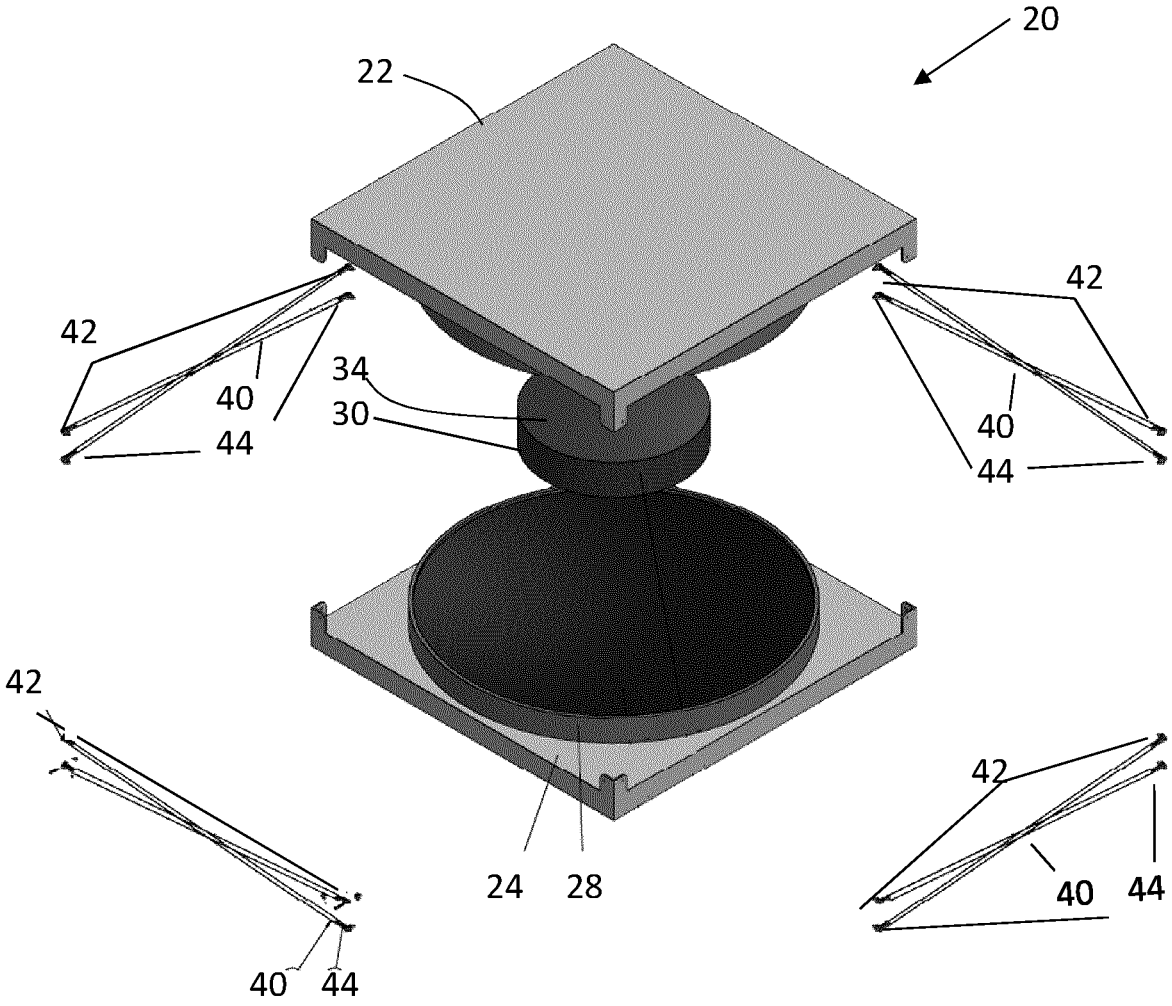
FIG. 6B is an exploded view of the smart friction pendulum system shown in FIG. 6A.
Figure 7:
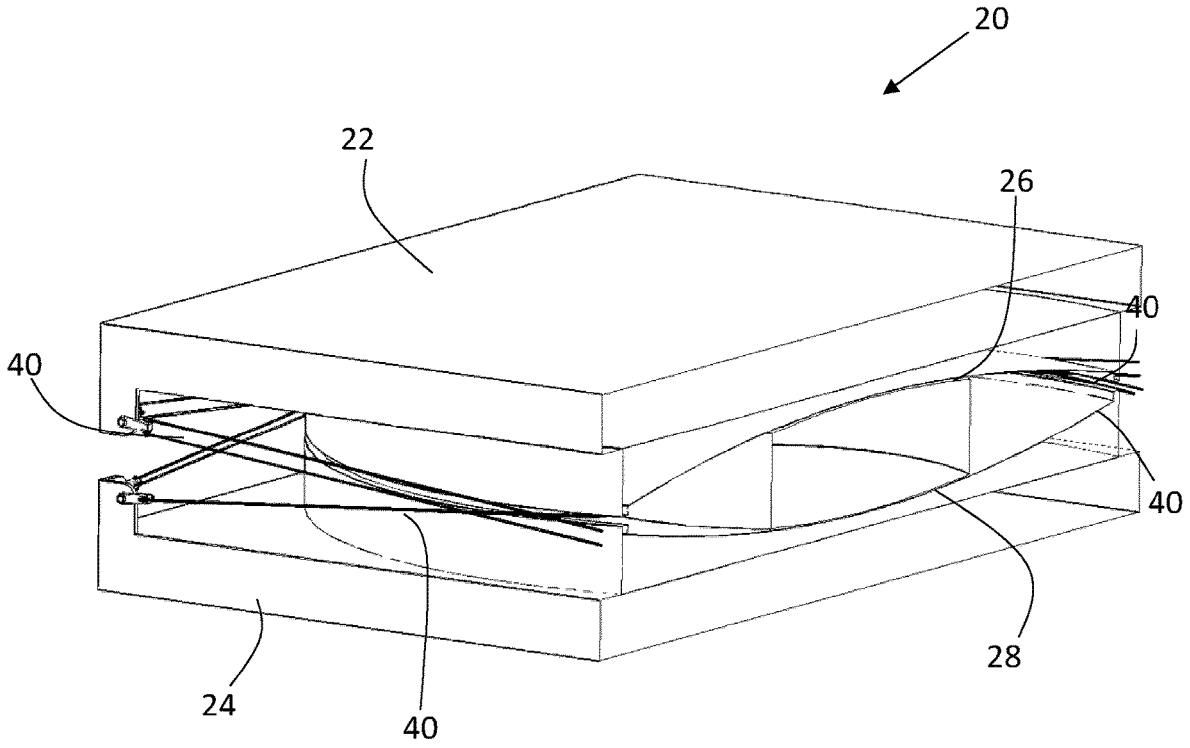
FIG. 7 is a cross sectional perspective view of the smart friction pendulum system of FIG. 6A.

According to embodiments, such as shown in FIG. 4, the inventive smart Friction Pendulum System (FPS) 20 includes an upper spherical plate 22 and a lower spherical plate 24 each having a curved sliding surface 26, 28 positioned facing towards one another. The inventive smart FPS 20 additionally includes a slider 30 positioned between the upper spherical plate 22 and the lower spherical plate 24 and a plurality of shape memory alloy (SMA) wires 40 each having a first end 42 and a second end 44. The first end 42 of each of the plurality of SMA wires 40 is attached to the upper spherical plate 22 and the second end 44 of each of the plurality of SMA wires 40 is attached to the lower spherical plate 24. A curved surface sliding material is attached to the bottom 32 and top 34 of the slider 30. As shown in FIG. 5, the inventive smart FPS 20 is attached between the foundation F and base mass B of a building to preserve the superstructures under the lateral loads. A slider 30 is located between two spherical plates 22, 24 and 8 SMA wires 40 are attached to the plates 22, 24, that is there are two SMA wires 40 on each of the four sides of the spherical plates 22, 24, as shown in FIGS. 6A, 6B, and 7; in which like reference numerals have the same meaning across various drawings. This mechanism covers all possible movements. It is appreciated that the plates are readily spaced apart through resort to spacer materials. These are not shown in the accompanying drawings for visual clarity. Materials from which a spacer is formed illustratively includes elastomers, perfluoropolymers, and laminar combinations thereof.

Figure 8A:
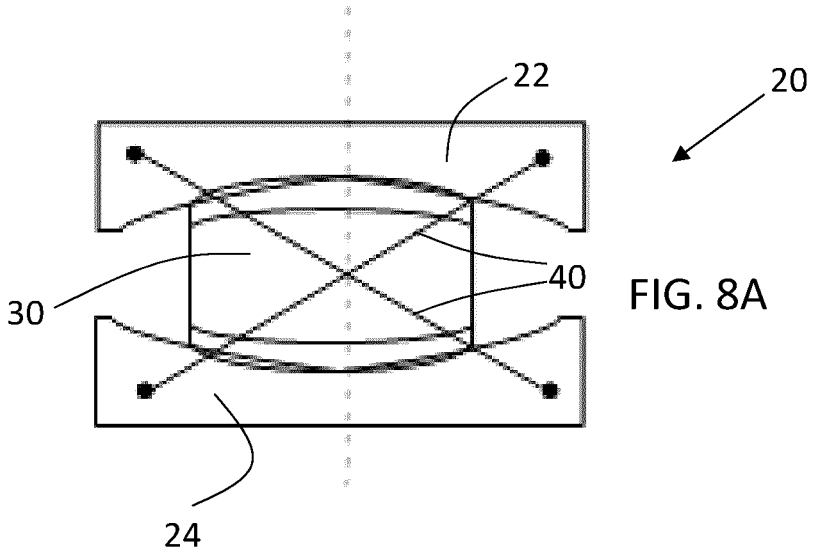
FIG. 8A is a schematic diagram of a smart friction pendulum system according to embodiments of the present disclosure in an unloaded state.
Figure 8B:
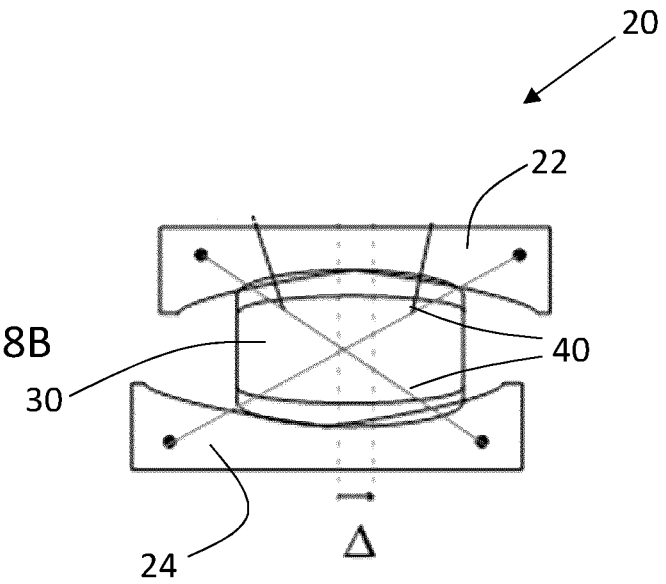
FIG. 8B is a schematic diagram of the smart friction pendulum system of FIG. 8A after a lateral load moves the systems to the right side.
Figure 8C:
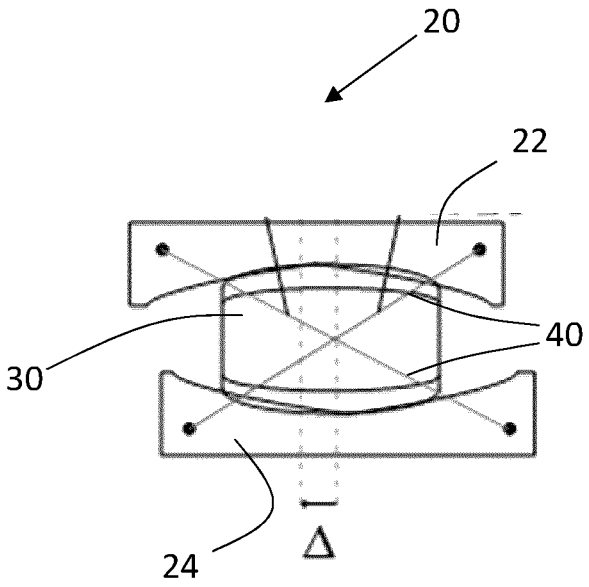
FIG. 8C is a schematic diagram of the smart friction pendulum system of FIG. 8A after a lateral load moves the systems to the left side.

The working mechanism of the inventive smart FPS 20 is shown in FIGS. 8A-8C. That is, FIG. 8A shows the smart FPS 20 when no load is applied. While the lateral loads move the systems to the right side, as shown in FIG. 8B, the system dissipates energy by providing friction between sliding material 20 and sliding surface 26, 28. The SMA wires 40 also absorb the energy when it goes to the inelastic reversible phase. The curved surface 26, 28 on the spherical plate 22, 24 helps the slider 30 and top spherical plate 22 to partially move back to the initial position. The embedded diagonal SMA wires 40 make the whole system recover the initial position fully. The system works in the same way if the system works oppositely and moves to the left, as shown in FIG. 8C.

Figure 3A:
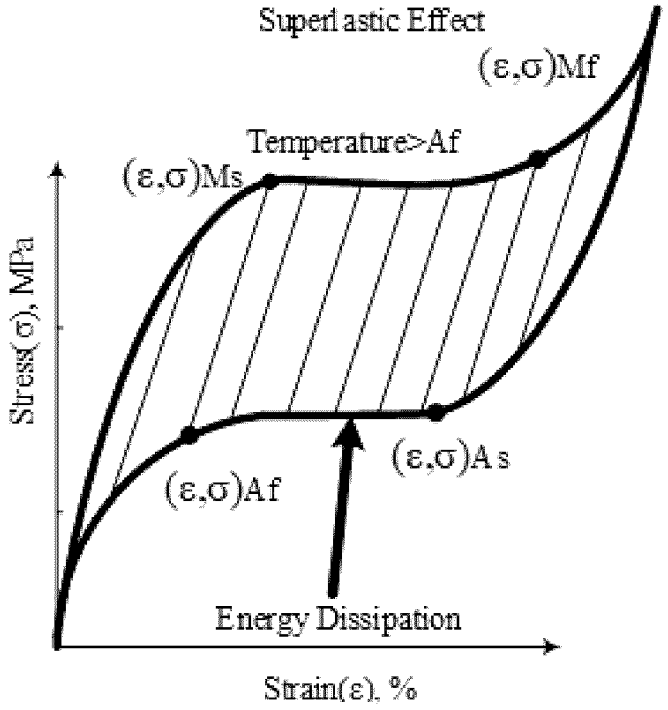
FIG. 3A is a graph showing the ideal hysteresis response of superelastic effect of a shape memory alloy.
Figure 3B:
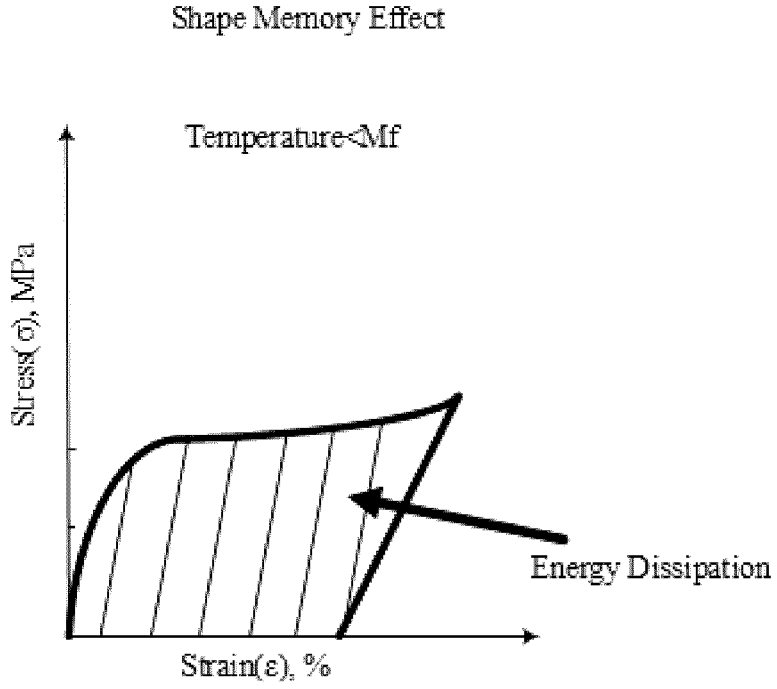
FIG. 3B is a graph showing the ideal hysteresis response of shape memory effect of a shape memory alloy.

Shape Memory alloy refers to a class of metallic alloys, that can recover their initial shape after experiencing large deformation from the original length. Exemplary of these materials are those detailed in Table 1 and 2. The shape memory effect (SME) and superelasticity (SE) are the main reasons SMAs exhibit this exceptional characteristic, as shown in FIGS. 3A and 3B. Recovery in SE happens when the external loads are removed, however in SME, heat internally or externally must be applied to the SMA to eliminate the permanent deformation (strains) and recover the initial state. SME and SE make SMAs ideal nominees for use in civil infrastructure to enhance the structural parameters, e,g, damping, the energy dissipation capacity, and particularly the recovery capability. In the SMA-based system, SE is widely used over the SME. It is mainly due to the simplicity in use and its ability to recover without the need to have a source of heat.

Figure 9:
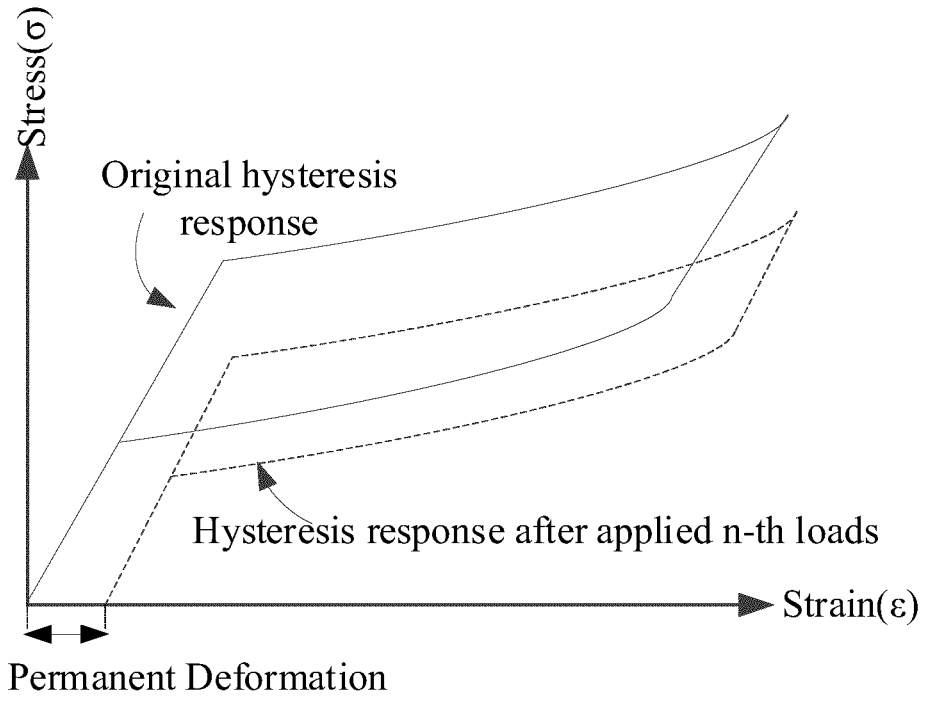
FIG. 9 is a graph showing a schematic hysteresis response of a pre-strained SMA according to embodiments of the present disclosure before and after applied cyclic loads.
Figure 10:
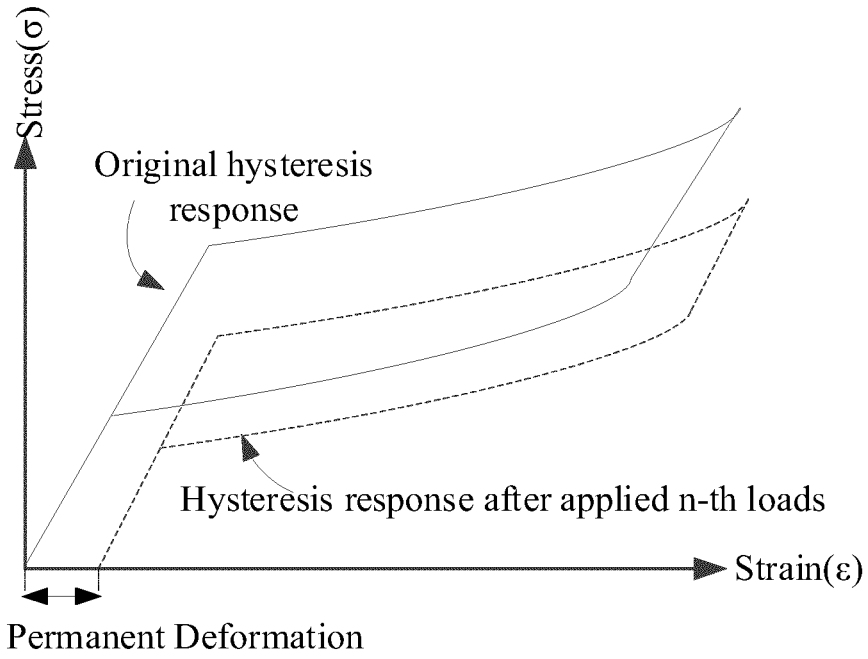
FIG. 10 PRIOR ART
FIG. 10 is a graph showing a schematic hysteresis response of a conventional, prior art SMA before and after applied cyclic loads.
Figure 11:
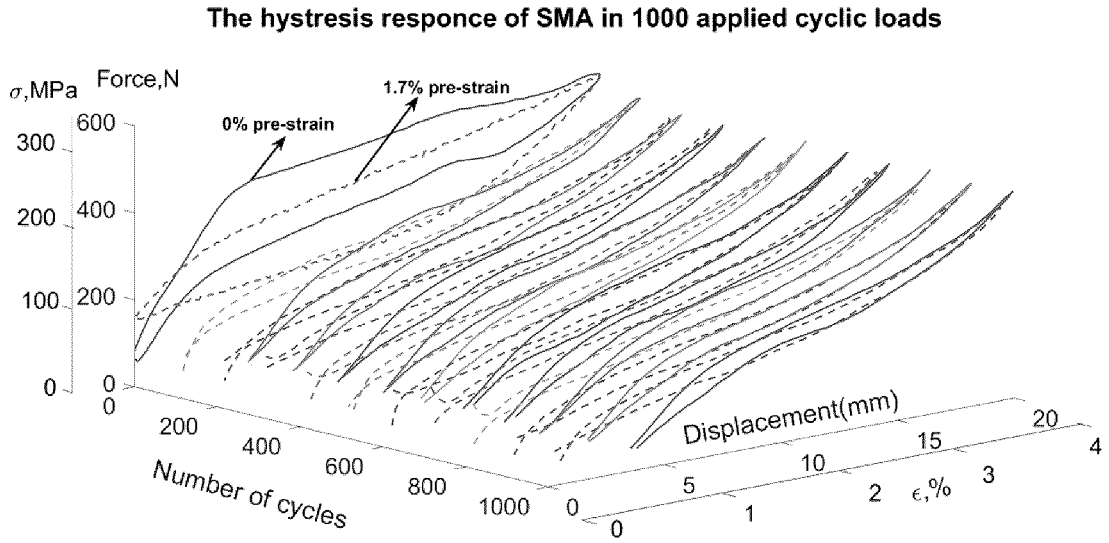
FIG. 11 is a graph showing the hysteresis responses of the 0% and 1.7% pre-strained specimen for 1000 cycles.
Figure 12:
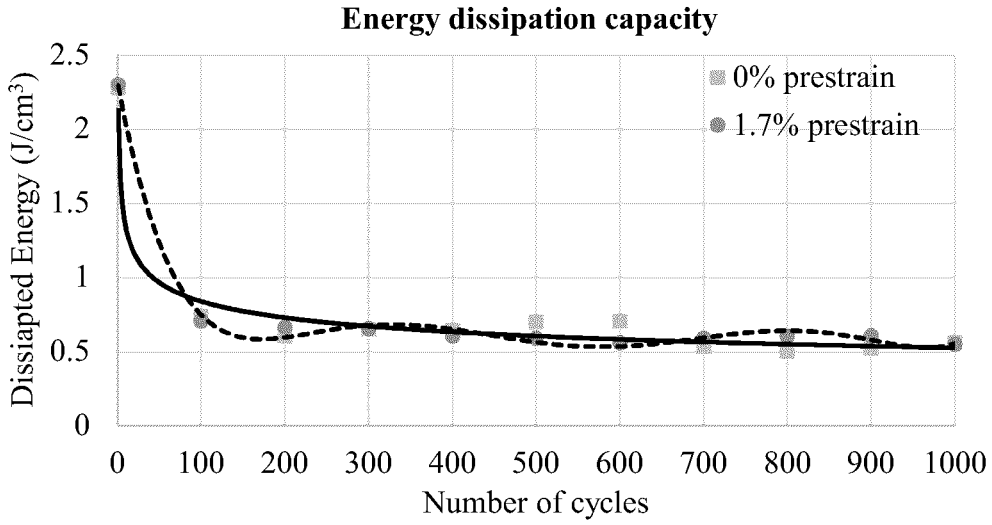
FIG. 12 is a graph showing energy dissipation capacity for 0% and 1.7% pre-strained specimen for 1000 cycles.

Like other metallic alloys, the functionality of SMAs can differ from ideal assumptions because of degradation under dynamic loads. The schematic diagram of the behavior is presented in FIG. 9. Hence, the energy dissipation capacity and recovery ability can be reduced, as presented in FIGS. 11 and 12. According to embodiments, to avoid such degradation, the SMA is pre-stressed. The pre-stressed SMA eliminates the permanent deformation in the long-term use. The only reduction in energy dissipation should be considered, as shown in FIG. 10, schematically for conventionally SMA material. The experimental results of the pre-strained SMA and change in the energy dissipation capacity are illustrated in FIGS. 11 and 12, respectively.

According to embodiments, the SMA wires 40 are formed of any of the shape memory alloys listed in Tables 1 and 2.

TABLE 1

Alloys having shape memory effect.

| Alloy | Composition | Transformation-temperature range °C. | Transformation-temperature range ° F. | Transformation hysteresis Δ ° C. | Transformation hysteresis Δ° F. |
|---|---|---|---|---|---|
| Ag—Cd | 44/49 at. % Cd | −190 to −50 | −310 to −60 | ≈15 | ≈25 |
| Au—Cd | 46.5/50 at. % Cd | 30 to 100 | 85 to 212 | ≈15 | ≈25 |
| Cu—Al—Ni | 14/14.5 wt % Al 3/4.5 wt % Ni | −140 to 100 | −220 to 212 | ≈35 | ≈65 |
| Cu—Sn | ≈15 at. % Sn | −120 to 30 | −185 to 85 | | |
| Cu—Zn | 38.5/41.5 wt % Zn | −180 to −10 | −290 to 15 | ≈10 | ≈20 |
| Cu—Zn—X (X = Si, Sn, Al) | a few wt % of X | −180 to 200 | −290 to 390 | ≈10 | ≈20 |
| In—Ti | 18/23 at. % Ti | 60 to 100 | 140 to 212 | ≈4 | ≈7 |
| Ni—Al | 36/38 at. % Al | −180 to 100 | −290 to 212 | ≈10 | ≈20 |
| Ni—Ti | 49/51 at. % Ni | −50 to 110 | −60 to 230 | ≈30 | ≈55 |
| Fe—Pt | ≈25 at. % Pt | ≈−130 | ≈−200 | ≈4 | ≈7 |
| Mn—Cu | 5/35 at. % Cu | −250 to 180 | −420 to 355 | ≈25 | ≈45 |
| Fe—Mn—Si | 32 wt % Mn, 6 wt % Si | −200 to 150 | −330 to 300 | ≈100 | ≈180 |

TABLE 2

Mechanical properties of SMAs*

| Alloy | $\varepsilon_{max}$ (%) | $\varepsilon_s$ (%) | $E_A$(MPα) | ($A_f$ ° C.) |
|---|---|---|---|---|
| $NiTi_{49.1}$ | 5 | 3.6 | 40.4 | 44.6 |
| $NiTi_{49.5}$ | 5.7 | 4.6 | 45.3 | 53.0 |

TABLE 2-continued

Mechanical properties of SMAs*

| Alloy | $\varepsilon_{max}$ (%) | $\varepsilon_s$ (%) | $E_A$(MPα) | ($A_f$ ° C.) |
|---|---|---|---|---|
| $NiTi_{50}$ | 3.1 | 2.2 | 117.8 | 77.8 |
| NITi | 8.2 | 6.8 | 30.0 | 42.9 |
| $NiTi_{45}$ | 6.8 | 6.0 | 62.5 | −10.0 |
| $NiTi_{44.1}$ | 6.5 | 5.5 | 39.7 | 0 |
| $NiTi_{40}Cu_{10}$ | 4.1 | 3.4 | 72.0 | 66.6 |
| $NiTi_{41}Cu_{10}$ | 4.1 | 3.1 | 91.5 | 50.0 |
| $NiTi_{41.5}Cu_{10}$ | 3.4 | 2.8 | 87.0 | 60.0 |
| $NiTi_{25}Cu_{25}$ | 10.0 | 2.5 | 14.3 | 73 |
| CuAlBe | 3.0 | 2.4 | 32.0 | −65 |
| FeMnAlNi | 6.1 | 5.5 | 98.4 | <−50 |
| FeNiCoAlTaB | 15.0 | 13.5 | 46.9 | −62.0 |

*as detailed in Shahin Zareie et al, Structures 27 (2020) 1535-1550.

Figure 13:
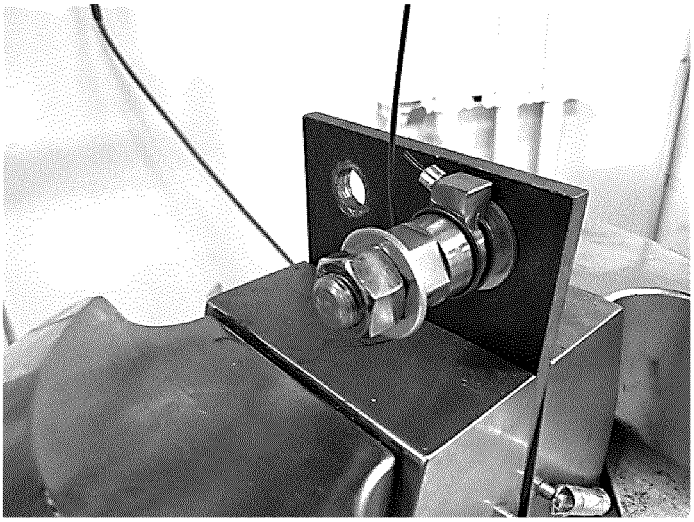
FIG. 13 is a photograph showing a system for applying pre-stress on the SMA wire according to embodiments of the present disclosure.
Figure 14:
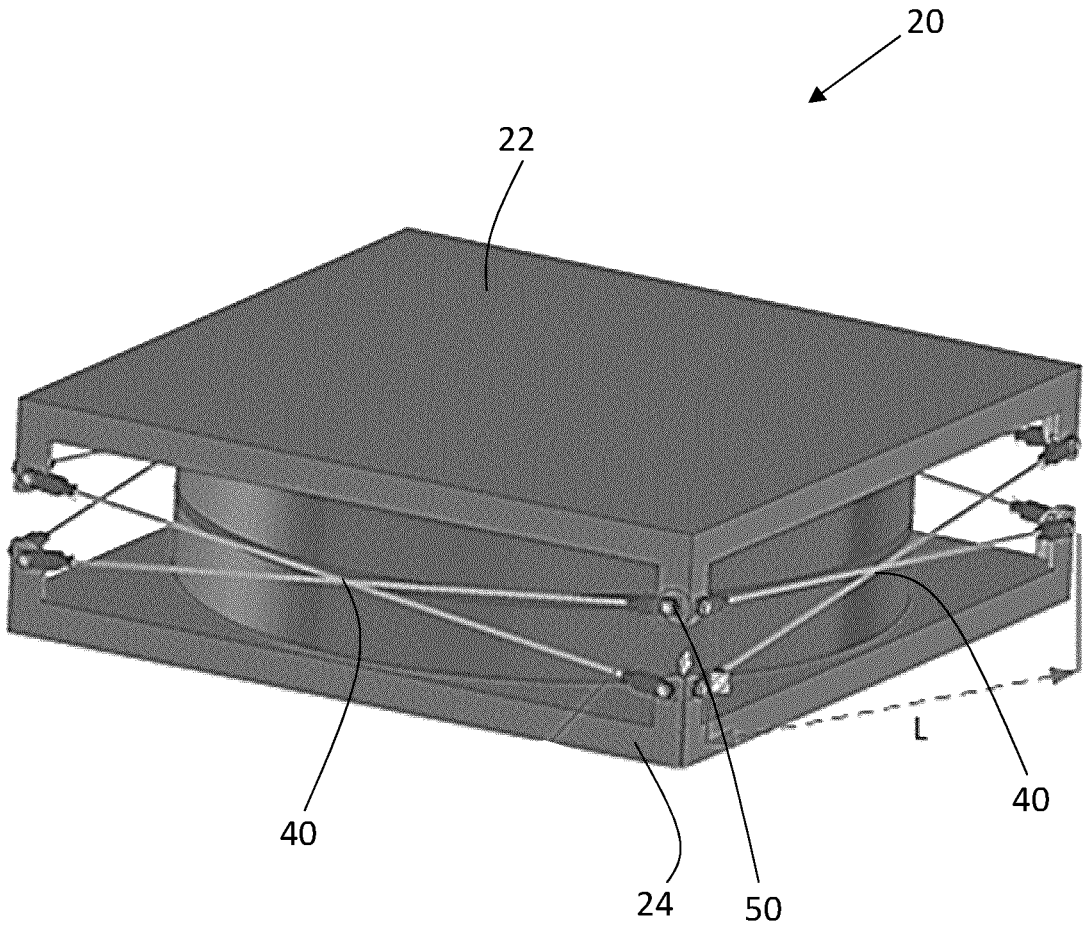
FIG. 14 is a perspective view of a smart friction pendulum system having a customized nut for applying pre-stress on the SMA according to embodiments of the present disclosure.
Figure 15A:
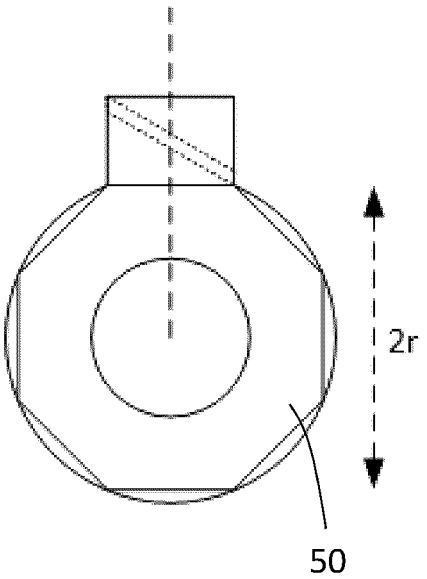
FIGS. 15A-15C are schematic diagrams showing the steps for applying pre-stress on SMA wires according to embodiments of the present disclosure.
Figure 15B:
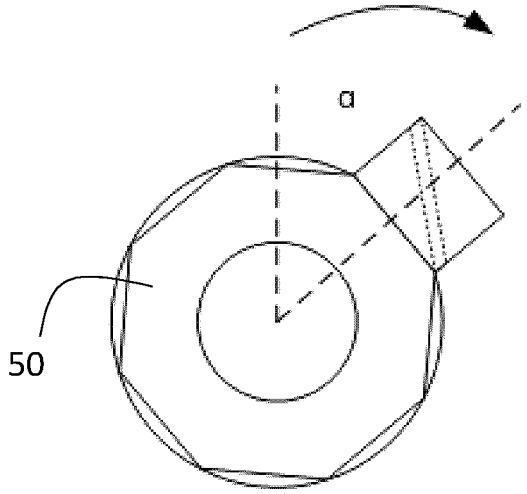
Figure 15C:
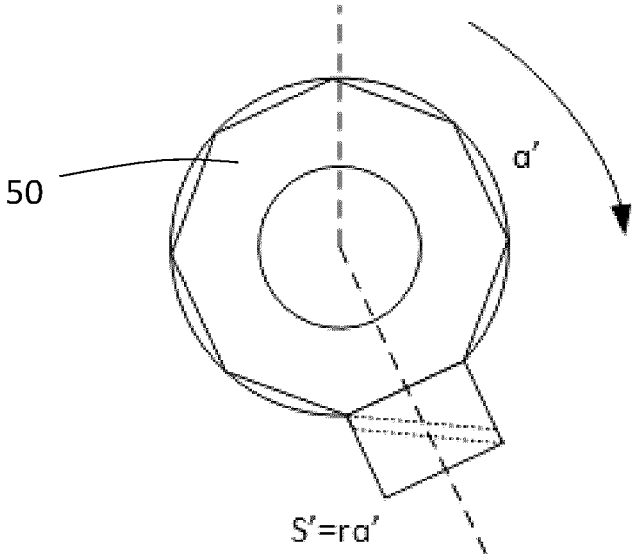

According to embodiments, the SMA is pre-stressed using a novel system using a customized nut 50, as provided in FIG. 13. According to embodiments, the pre-stressing system using a customized nut 50 is implemented into the smart FPS, as displayed in FIG. 14. FIGS. 15A-15C show the steps for pre-stressing the SMA wires according to embodiments of the present invention. In pre-stressed materials such as concrete, SMA bars are provided in some inventive embodiments. As a result, such pre-stressed materials exhibit reduced crack propagation and improvements in material fatigue resistance are noted when used in the context of an inventive FPS.

According to embodiments, the smart FPS 20 is configured to be integrated with different types of steel, concrete, and timber buildings, particularly high-rise ones, to provide their stability and serviceability under ground movements having different intensities, frequency contents, and magnitudes. The systems are easily installed in the foundations of already constructed buildings without changing the structural elements to retrofit them as well as in new construction buildings. By using the inventive smart system, the life expectancy of new and existing buildings can be extended due to meeting new requirements and safety codes determined by updated regulations and buildings codes. An additional benefit of the inventive smart FPS is its optimization of construction materials.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The foregoing description is illustrative of particular embodiments of the invention but is not meant to be a limitation upon the practice thereof. The following claims, including all equivalents thereof, are intended to define the scope of the invention.

The invention claimed is:

1. A smart friction pendulum system comprising:

an upper spherical plate having an upper plate first side and a lower spherical plate having a lower plate first side that is vertically displaced from the upper plate side each having a sliding surface;

a slider positioned between the upper spherical plate and the lower spherical plate and having a slider first side proximal to the upper plate first side and the lower plate first side; and a plurality of shape memory alloy (SMA) wires each having a first end and a second end;

wherein the first end of each of the plurality of SMA wires is attached to the upper spherical plate and the second end of each of the plurality of SMA wires is attached to the lower spherical plate and two wires of the plurality of shape memory alloy (SMA) wires are attached to the upper plate first side and the lower plate first side to form an X-shape.

2. The smart friction pendulum system of claim 1 wherein the sliding surface on the upper spherical plate is curved.

3. The smart friction pendulum system of claim 1 wherein the sliding surface on the lower spherical plate is curved.

4. The smart friction pendulum system of claim 1 further comprising a sliding material positioned on an upper surface of the slider.

5. The smart friction pendulum system of claim 1 further comprising a sliding material positioned on a lower surface of the slider.

6. The smart friction pendulum system of claim 1 wherein an upper surface of the slider is curved.

7. The smart friction pendulum system of claim 1 wherein a lower surface of the slider is curved.

8. The smart friction pendulum system of claim 1 wherein the smart friction pendulum system is configured to be installed between a foundation and a base mass of a civil infrastructure.

9. The smart friction pendulum system of claim 1 wherein the smart friction pendulum system is configured to preserve a civil infrastructure under lateral loads.

10. The smart friction pendulum system of claim 1 wherein the smart friction pendulum system is configured to dissipate energy by providing friction between the sliding surfaces and the slider.

11. The smart friction pendulum system of claim 1 wherein the plurality of SMA wires is at least eight SMA wires.

12. The smart friction pendulum system of claim 1 wherein two additional SMA wires of the plurality of SMA wires are positioned on an upper plate second side and a lower plate side that are proximal to a slide second side and arranged in another X-shape.

13. The smart friction pendulum system of claim 1 wherein each of the plurality of SMA wires is positioned diagonally between the upper spherical plate and the lower spherical plate.

14. The smart friction pendulum system of claim 1 wherein each of the plurality of SMA wires are configured to deform and subsequently recover their initial shape.

15. The smart friction pendulum system of claim 1 wherein each of the plurality of SMA wire is pre-stressed.

16. The smart friction pendulum system of claim 1 wherein the first end of each of the plurality of SMA wires is attached to the upper spherical plate by a pre-stressing nut.

17. The smart friction pendulum system of claim 1 wherein the second end of each of the plurality of SMA wires is attached to the lower spherical plate by a pre-stressing nut.

18. The smart friction pendulum system of claim 1 wherein at least one of the plurality of SMA wires is pre-stressed.

* * * * *